US009994018B2

(12) United States Patent
Yaginuma et al.

(10) Patent No.: US 9,994,018 B2
(45) Date of Patent: Jun. 12, 2018

(54) LIQUID EJECTION HEAD AND METHOD OF PRODUCING THE SAME

(71) Applicant: CANON KABUSHIKI KAISHA, Tokyo (JP)

(72) Inventors: Seiichiro Yaginuma, Kawasaki (JP); Jun Yamamuro, Yokohama (JP); Kazuhiro Asai, Kawasaki (JP); Keiji Matsumoto, Fukushima (JP); Koji Sasaki, Nagareyama (JP); Masahisa Watanabe, Yokohama (JP); Kunihito Uohashi, Yokohama (JP); Ryotaro Murakami, Yokohama (JP); Tomohiko Nakano, Kawasaki (JP); Keiji Edamatsu, Kawasaki (JP); Haruka Nakada, Kawasaki (JP); Kenji Fujii, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/218,998

(22) Filed: Jul. 25, 2016

(65) Prior Publication Data

US 2017/0028730 A1 Feb. 2, 2017

(30) Foreign Application Priority Data

Jul. 31, 2015 (JP) ..... 2015-151547

(51) Int. Cl.
*B41J 2/14* (2006.01)
*B41J 2/16* (2006.01)

(52) U.S. Cl.
CPC ..... *B41J 2/14145* (2013.01); *B41J 2/1603* (2013.01); *B41J 2/1623* (2013.01); (Continued)

(58) Field of Classification Search
CPC ..... B41J 2/1603; B41J 2/1623; B41J 2/1631; B41J 2/1642; B41J 2/14145; (Continued)

(56) References Cited

U.S. PATENT DOCUMENTS 7,325,310 B2 * 2/2008 Kim ..... B41J 2/14137 216/27

FOREIGN PATENT DOCUMENTS

JP 2000-094700 A 4/2000

* cited by examiner

*Primary Examiner* — Kristal Feggins
(74) *Attorney, Agent, or Firm* — Canon U.S.A., Inc. IP Division

(57) ABSTRACT

A liquid ejection head includes a liquid ejection board and a liquid ejection head component disposed on the liquid ejection board. The liquid ejection board includes a substrate, an energy generating device on the substrate, a channel defining member defining a liquid channel and having a liquid ejection opening in communication with the liquid channel, a liquid supply passage in communication with the liquid channel, a liquid supply opening in communication with the liquid supply passage and having a smaller opening cross-sectional area taken in a direction perpendicular to a flow direction of a liquid than the liquid supply passage, and an opening in communication with the liquid channel. The liquid channel allows a liquid to be in contact with the energy generating device. The liquid ejection opening allows a liquid to be ejected therethrough. The liquid ejection head component closes at least a portion of the opening.

5 Claims, 12 Drawing Sheets

(52) U.S. Cl.
CPC ..... *B41J 2/1631* (2013.01); *B41J 2/1642* (2013.01); *B41J 2002/14403* (2013.01)

(58) Field of Classification Search
CPC ..... B41J 2/17503; B41J 2/17563; B41J 2/17566; B41J 2/17593; B41J 2/17596; B41J 2/18
See application file for complete search history.

LIQUID EJECTION HEAD AND METHOD OF PRODUCING THE SAME

BACKGROUND OF THE INVENTION

Field of the Invention

The present invention relates to liquid ejection heads and methods of producing the same.

Description of the Related Art

A liquid ejection head used in a liquid ejection apparatus such as an inkjet recording apparatus may include a structure configured to prevent entry of bubbles or foreign substances in a liquid. Japanese Patent Laid-Open No. 2000-94700 discloses a method of forming a membrane filter, which is configured to prevent entry of bubbles and foreign substances, in a liquid ejection head, concurrently with an ink supply portion. In the invention described in Japanese Patent Laid-Open No. 2000-94700, an ink passes through openings in the membrane filter, i.e., the openings in the membrane filter serve as liquid supply openings. The openings are desired to have the smallest possible diameter and to be arranged at the smallest possible intervals to prevent entry of foreign substances, for example.

SUMMARY OF THE INVENTION

An aspect of the invention provides a liquid ejection head including a liquid ejection board and a liquid ejection head component. The liquid ejection board includes a substrate, an energy generating device on a first surface of the substrate, a channel defining member defining a liquid channel and having a liquid ejection opening in communication with the liquid channel, a liquid supply passage in communication with the liquid channel, a liquid supply opening in communication with the liquid supply passage, and an opening in communication with the liquid channel. The liquid channel allows a liquid to be in contact with the energy generating device. The liquid ejection opening allows a liquid to be ejected therethrough. The liquid supply opening has a smaller opening cross-sectional area taken in a direction perpendicular to a flow direction of a liquid than the liquid supply passage. The opening is included in addition to the liquid ejection opening and the liquid supply passage. The liquid ejection head component is disposed on the liquid ejection head so as to close at least a portion of the opening.

Another aspect of the invention provides a method of producing a liquid ejection head including forming a liquid ejection board and disposing a liquid ejection head component on the liquid ejection board. The forming the liquid ejection board includes forming an energy generating device on a first surface of a substrate, forming a channel defining member defining a liquid channel and having a liquid ejection opening in communication with the liquid channel on the first surface of the substrate, forming a liquid supply passage in communication with the liquid channel, forming a liquid supply opening in communication with the liquid supply passage, and forming an opening in the liquid ejection board so as to be in communication with the liquid channel. The channel defining member allows a liquid to be in contact with the energy generating device. The liquid ejection opening allows a liquid to be ejected therethrough. The liquid supply opening has a smaller opening cross-sectional area taken in a direction perpendicular to a flow direction of the liquid than the liquid supply passage. The opening is formed in addition to the liquid ejection opening and the liquid supply passage. The disposing the liquid ejection head component on the liquid ejection board includes disposing the liquid ejection head component so as to close at least a portion of the opening.

Further features of the present invention will become apparent from the following description of exemplary embodiments with reference to the attached drawings.

DESCRIPTION OF THE EMBODIMENTS

A liquid ejection head may include a structure such as a membrane filter configured to prevent entry of bubbles and foreign substances or a member for separating a liquid channel, for example. Such a component may reduce an opening area of the liquid ejection head, making it difficult for a liquid to be replaced or released. As a result, a residue is readily generated in steps of producing the liquid ejection head. The residue lowers the quality of the liquid ejection head or decreases the yield of the liquid ejection head. The present invention provides a liquid ejection head configured to reduce generation of residues, for example, in the steps of producing the liquid ejection head so as to improve the quality and the yield.

Embodiments

Hereinafter, embodiments of the present invention are described with reference to the drawings. A material, structure, and production method, for example, of the present invention are not limited to those described below.

Figure 1:
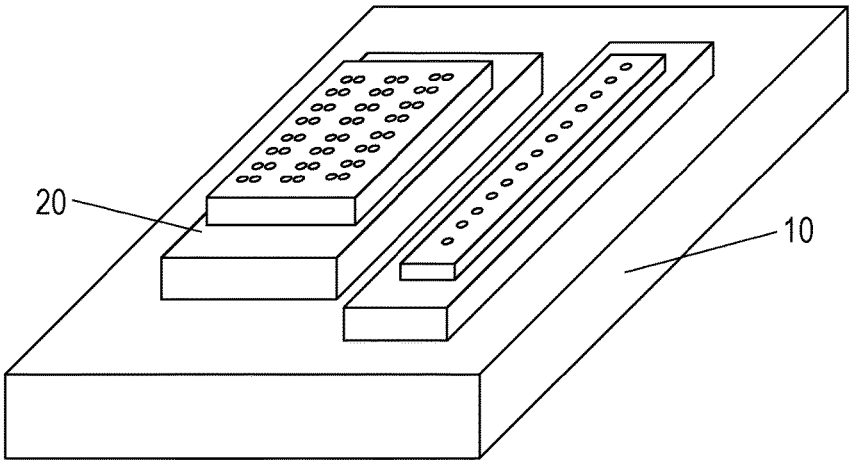
FIG. 1 is a view illustrating an example of a liquid ejection head according to the present invention.

FIG. 1 is a view illustrating an example of a liquid ejection head according to an embodiment of the invention. The liquid ejection head according to the invention includes a liquid ejection head component 10 and a liquid ejection board 20 disposed on the liquid ejection head component 10.

Figure 2A:
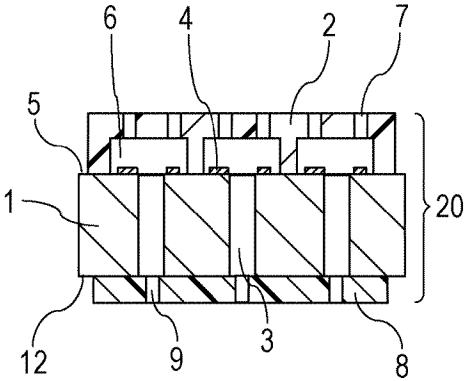
FIGS. 2A to 2G are views illustrating a liquid ejection head, a liquid ejection board, and a liquid ejection head component, the liquid ejection board and the liquid ejection head component constituting the liquid ejection head.
Figure 2B:
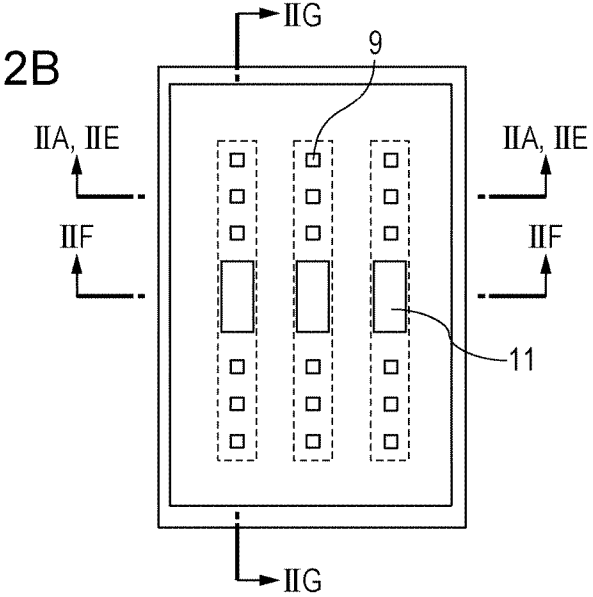

FIGS. 2A to 2G are views illustrating an example of a liquid ejection head according to one embodiment of the invention, an example of the liquid ejection board 20, and an example of the liquid ejection head component 10. The liquid ejection board 20 and the liquid ejection head component 10 are components of the liquid ejection head. FIGS. 2A and 2B each illustrate the liquid ejection board 20. FIG. 2A is a cross-sectional view taken along line IIA-IIA in FIG.

Figure 2C:
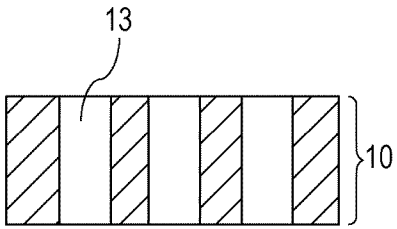
Figure 2D:
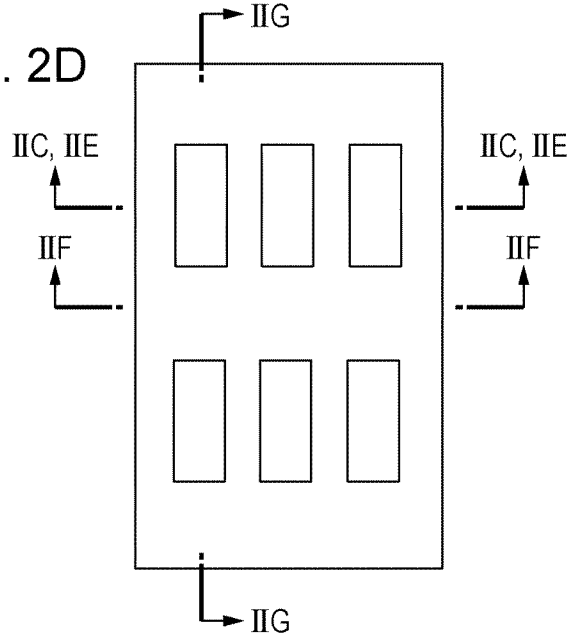
Figure 2E:
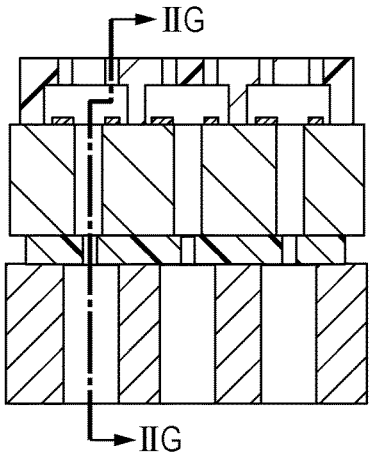
Figure 2F:
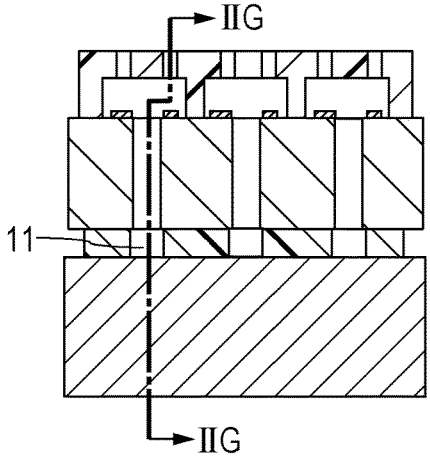
Figure 2G:
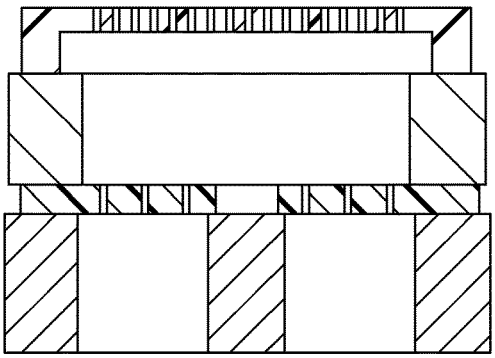
Figure 3A:
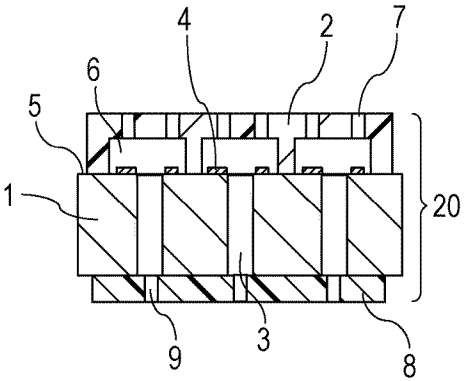
FIGS. 3A to 3G are views illustrating an example of a conventional liquid ejection head.
Figure 3B:
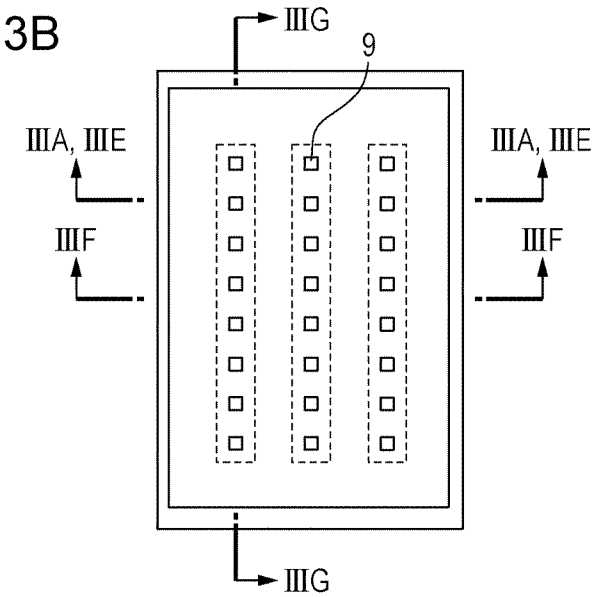
Figure 3C:
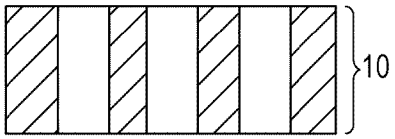
Figure 3D:
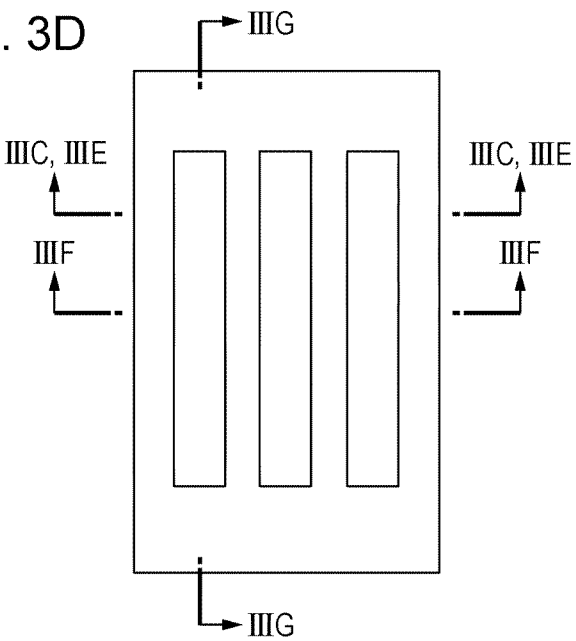
Figure 3E:
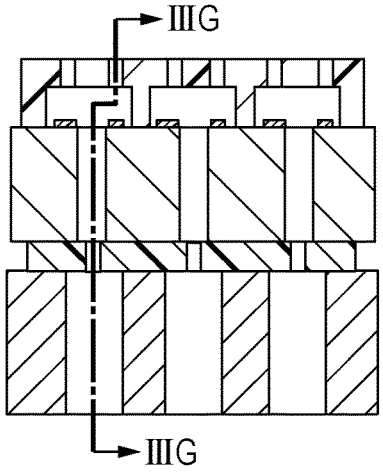
Figure 3F:
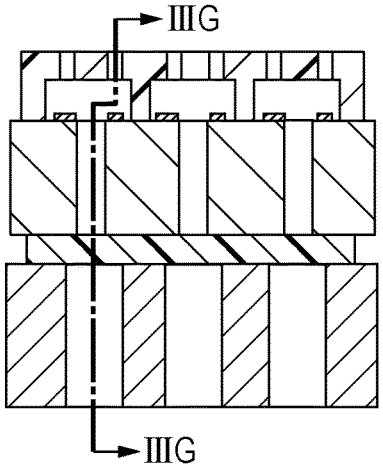
Figure 3G:
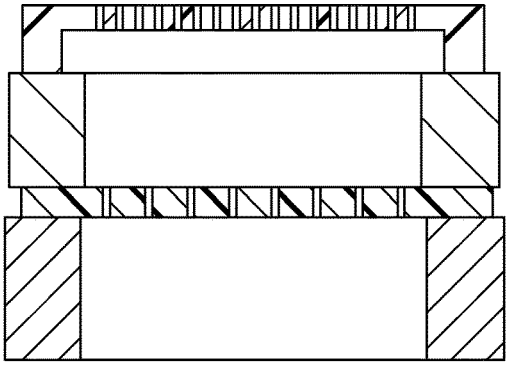

2B. FIG. 2B is a view viewed from a side of a liquid supply opening member 8. FIGS. 2C and 2D each illustrate the liquid ejection head component 10. FIG. 2C is a cross-sectional view taken along line IIC-IIC in FIG. 2D. FIG. 2D is a view of a surface of the liquid ejection head component 10 to be connected to the liquid ejection board 20. FIGS. 2E, 2F, and 2G are cross-sectional views of the liquid ejection head including the liquid ejection head component 10 and the liquid ejection board 20 disposed on the liquid ejection head component 10. FIG. 2E is a cross-sectional view taken along line IIE-IIE in FIGS. 2B and 2D. FIG. 2F is a cross-sectional view taken along line IIF-IIF in FIGS. 2B and 2D. FIG. 2G is a cross-sectional view taken along line IIG-IIG in FIG. 2B, 2D, 2E, or 2F.

As illustrated in FIG. 2A, the liquid ejection board 20 includes a substrate 1, a channel defining member 2, liquid supply passages 3, and liquid supply openings 9. Energy generating devices 4 are disposed on a front surface 5 (first surface) of the substrate 1. The channel defining member 2 defines liquid channels 6 and has liquid ejection openings 7 through which a liquid is ejected. The liquid ejection openings 7 are in communication with the liquid channels 6. The liquid channels 6 enable a liquid to be in contact with the energy generating devices 4. The liquid supply passages 3 are in communication with the liquid channels 6. The liquid supply openings 9 are in communication with the liquid supply passages 3. The liquid ejection board 20 further includes openings 11 in communication with the liquid channels 6. The openings 11 are included in addition to the liquid ejection openings 7 and the liquid supply passages 3. The openings 11 are closed by the liquid ejection head component 10. In this embodiment, the liquid supply openings 9 and the openings 11 are formed in the liquid supply opening member 8.

The liquid ejection head illustrated in FIGS. 2A to 2G includes the liquid supply opening member 8 having the liquid supply openings 9 and the openings 11 on a rear surface 12 (second surface) of the substrate 1 opposite the front surface 5. The openings 11 are in communication with the liquid channels 6 through the liquid supply passages 3. Hereinafter, components of the liquid ejection head are described.

Liquid Ejection Board 20

Substrate 1

The substrate 1 includes a substrate able to have a semiconductor device such as a transistor or a circuit. Examples of a material of the substrate include Si, Ge, SiC, GaAs, InAs, GaP, a diamond, an oxide semiconductor such as ZnO, a nitride semiconductor such as InN or GaN, a mixture thereof, and a semiconductor material such as an organic semiconductor. The substrate 1 may include a substrate formed of glass, $Al_2O_3$, resin, or metal, for example, and a circuit including a thin film transistor, for example. The substrate may be an SOI substrate, or a substrate including plastic and metal layers bonded together, for example. Among them, the substrate 1 can particularly include a silicon substrate formed of Si.

Liquid Supply Passage 3

The liquid supply passages 3 are at least a portion of through holes in the substrate 1. The through holes are in communication with the liquid channels 6 and extend between the front surface 5 (first surface) of the substrate 1 and the rear surface 12 (second surface) opposite the front surface 5. In FIGS. 2A to 2G, all the through holes are the liquid supply passages 3. The size, shape, number, and position of the liquid supply passages 3 may be determined without limitations, and are not limited to those illustrated in the drawings. A support, a passage filter, or a membrane filter, for example, may be disposed at any position of the liquid supply passage 3 without deteriorating the advantages of the present invention. In some embodiments, the liquid supply passages 3 are not through holes and do not extend through the substrate 1. The liquid supply passages 3 may be grooves in the front surface 5 of the substrate 1, or may be through holes or grooves in the liquid channel defining member 2, which is described later. A liquid outside the liquid ejection board 20 is introduced into the liquid channels 6 through the liquid supply passages 3.

Energy Generating Device 4

The energy generating devices 4 and connecting terminals (not illustrated) are disposed on the front surface 5 (first surface) of the substrate 1. The energy generating devices 4 may be energy generating devices commonly used in the art. Examples of the energy generating device 4 include a heater element including TaSiN, for example, an electromagnetic wave heating element, which generates thermal energy, a piezoelectric element and an ultrasonic element, which generate mechanical energy, an element that generates electric energy, and an element that generates magnetic energy. The generated energy is used to eject the liquid. The energy generating devices 4 may be in contact with the front surface 5 of the substrate 1, or the energy generating devices 4 each may partly be in non-contact with the front surface 5 of the substrate 1. The energy generating devices 4 may be covered with an insulating layer or a protective layer.

Channel Defining Member 2

The channel defining member 2, which constitutes walls of the liquid channel 6, is disposed on the front surface 5 of the substrate 1. The channel defining member 2 is formed of a resin material such as a photosensitive resin. The photosensitive resin may be any one of a negative photosensitive resin and a positive photosensitive resin. The channel defining member 2 can be particularly formed of a negative photosensitive resin. Examples of the negative photosensitive resin include an epoxy resin. Examples of a commercially available epoxy resin include EHPE-3150, which is a product name available from Daisel Corporation. The photosensitive resin may include one kind of the resin materials or two or more kinds of the resin materials. The material of the channel defining member 2 is not limited to the resin material, and may be a metal material, a semiconducting material, an insulating material, or any combination thereof. The channel defining member 2 may include at least one layer formed of the above-described material. The channel defining member 2 may further include a contact layer for enhancing the contact, a planarizing layer, or an antireflection layer. Such layers may be disposed between the channel defining member 2 and the substrate 1 or may be disposed between any two of the layers of the channel defining member 2 if the channel defining member 2 includes two or more layers.

Liquid Channel 6 and Liquid Ejection Opening 7

The channel defining member 2 includes the liquid channels 6, which allow a liquid to be in contact with the energy generating devices 4, and has the liquid ejection openings 7 in communication with the liquid channels 6. The liquid is ejected through the liquid ejection openings 7. The size, shape, number, and position of the liquid channels 6 and the size, shape, number, and position of the liquid ejection openings 7 may be determined without limitations, and are not limited to those illustrated in the drawings. However, the liquid ejection openings 7 are typically configured to have a smaller opening cross-sectional area, which is taken in a direction perpendicular to a flow direction of the liquid (hereinafter, may be simply referred to as an opening cross-sectional area), than the liquid supply passages 3 and the liquid channels 6.

Liquid Supply Opening Member 8 and Liquid Supply Opening 9

The liquid ejection board 20 has the liquid supply openings 9 in communication with the liquid supply passages 3. The shape, number, and position of the liquid supply openings 9 may be determined without limitations as long as the liquid supply openings 9 have a larger opening cross-sectional area, which is taken in a direction perpendicular to a flow direction of the liquid, than the liquid supply passages 3, and are not limited to those illustrated in the drawings. In the configuration illustrated in FIGS. 2A to 2G, for example, a liquid flows in the liquid supply passages 3 and the liquid supply openings 9 in a vertical direction of the substrate 1. The direction perpendicular to the flow direction of the liquid is a direction parallel to the front and rear surfaces 5 and 12 (first and second surfaces) of the substrate 1.

The liquid supply openings 9 may be portions of the through holes in the substrate 1 as the liquid supply passages 3. The portions are adjacent to the rear surface 5 of the substrate 1. In the case that the liquid ejection head includes the liquid supply opening member 8, the liquid supply openings 9 may be formed in the liquid supply opening member 8. The liquid supply openings 9 may be formed in the substrate 1 at a position adjacent to the front surface 5. In such a case, the openings 11 may be formed in the channel defining member 2 to reduce the generation of residues, for example, in the steps of producing the liquid ejection head. The liquid supply openings 9 may be used to filter bubbles and foreign substances, to separate the liquid so as to flow into different liquid supply passages 3, or to adjust resistance applied to the liquid, for example. The liquid supply openings 9 can have a smaller opening area than the liquid ejection openings 7 to reduce entry of foreign substances, which may cause clogging of the liquid ejection openings 7. The liquid supply openings 9 having the smaller opening area can provide filtering effect.

The liquid supply opening member 8 may be disposed on the rear surface 12 (second surface) of the substrate 1 as illustrated in FIGS. 2A to 2G, or may be disposed on any surface depending on the pathway of the liquid supply passages 3. The liquid supply opening member 8 may have any shape and thickness. The liquid supply opening member 8 may be partly disposed in the liquid supply passages 3 or may cover a side wall of the liquid supply passage 3. The liquid supply opening member 8 partly disposed in the liquid supply passage 3 enhances the contact between the liquid supply opening member 8 and the substrate 1 and increases the strength of the substrate 1. In addition, the liquid supply opening member 8 functions as a protective film when covering the side wall of the liquid supply passage 3. The liquid supply opening member 8 may have the openings 11. The liquid supply opening member 8 and the channel defining member 2 may be connected to each other. The liquid supply opening member 8 is an optional component as described above, and may be omitted.

The liquid supply opening member 8 may be formed of a metal material, a semiconducting material, an insulating material, or a resin material, for example. Examples of the metal material include, Al, Cu, Ni, Ti, Fe, Mn, Mo, Sn, Cr, Ca, Pt, Au, Ag, Pd, W, Be, Na, Co, Sc, Zn, Ga, V, Nb, Ir, Hf, Ta, Hg, Bi, Pb, and a mixture thereof. Further examples of the metal material include La, Ce, Nd, Sm, and a mixture thereof. The liquid supply opening member 8 may be formed of SUS, which is a widely used alloy, or a metal glass, for example. The liquid supply opening member 8 may be formed of an oxide, nitride, nitrogen oxide, carbide, fluoride, boride of the above-described metal, or a mixture thereof. Examples of the semiconducting material include Si, Ge, SiC, GaAs, InAs, GaP, GaN, SiN, and BN. The liquid supply opening member 8 may further include a carbon material such as diamond-like carbon, graphite, or a carbon nanotube. Examples of the resin material include an acrylic resin, polyimide, polyamide, polyurethane, polycarbonate, polyethylene terephthalate, fluororesin, polystyrene, polypropylene, polyvinyl chloride, and biodegradable plastic. The liquid supply opening member 8 may have a layered structure including layers formed of the above-described materials, and may include a device or liquid passage, for example. The liquid supply opening member 8 formed of the above-described materials may be coated to improve resistance against chemicals, to prevent reflection, or to enhance the contact between the liquid supply opening member 8 and the other components.

The liquid supply opening member 8 may be attached to the substrate 1 after processed, or may be processed after attached to the substrate 1. In the case that the processed liquid supply opening member 8 is attached to the substrate 1, misalignment may occur during the attachment, and thus the positioning with high accuracy may be difficult. In addition, an additional member such as a support may be required in the step of forming the liquid supply openings 9, for example, in the liquid supply opening member 8. This may increase the number of steps, leading to an increase in the production cost. In the case that the liquid supply opening member 8 is processed to have the liquid supply openings 9, for example, after the liquid supply opening member 8 is attached to the substrate 1, positioning accuracy is improved. In addition, the substrate 1 may be used as a support for transporting, for example, reducing an increase in the production cost. A method of forming the liquid supply openings 9 and the openings 11 in the liquid supply opening member 8 is not limited, and may be suitably determined depending on the material of the liquid supply opening member 8. Examples of the method include photolithography, laser ablation, and mechanical boring using a drill. The liquid supply opening member 8 may be formed of a porous material or mesh material including holes. Some of the holes in communication with the liquid supply passages 3 may be used as liquid supply openings 9. Thus, only the openings 11 need to be formed. In addition, the liquid supply opening member 8 may have a multi-layered structure and may have grooves as passages in communication with the liquid supply openings 9.

A contact layer may be formed on a joint surface of at least one of the substrate 1 and the liquid supply opening member 8, or a plasma treatment or a treatment with a primer may be performed on a joint surface of at least one of the substrate 1 and the liquid supply opening member 8 in order to enhance the contact between the substrate 1 and the liquid supply opening member 8. The liquid supply opening member 8 may be connected to the substrate 1 by using an adhesive such as a thermosetting adhesive, a light curing adhesive, a moisture reactive adhesive, or a low-melting-point metal. The adhesive may be in a liquid form, a solid form such as a film form, or a form of mist. Further examples of the adhesive include a thermally releasable adhesive film, a photo-releasable adhesive film, and an adhesive film releasable with force. The liquid supply opening member 8 may be welded with heat or ultra-sonic sound waves, or may be connected by surface activated bonding with plasma or ion beams. A material for connection between the substrate 1 and the liquid supply opening member 8 may be applied on the substrate 1. The surface of the substrate 1 may be flattened. The liquid supply opening member 8 may be formed on the substrate 1 by coating, deposition, chemical vapor deposition (CVD), sputtering, or plating, for example. The liquid supply opening member 8 may include a circuit. The circuit in the liquid supply opening 8 and the circuit in the substrate 1 may be connected to each other.

The liquid supply opening member 8 may be formed of a photosensitive resin. The photosensitive resin enables the liquid supply opening member 8 to be processed with high accuracy. The photosensitive resin can be a negative photosensitive resin. A resin having high resistance to heat and chemicals can provide a wider range of freedom in the production steps and can improve reliability of the production. The photosensitive resin can include at least one of a polyimide resin, polyamide resin, epoxy resin, polycarbonate resin, acrylic resin, and fluorine resin. Among them, an epoxy resin can be particularly used. The photosensitive resin may further include a photo acid generator, a sensitizer, a reducing agent, an adhesion improving additive, a water repellent, or an electromagnetic wave absorber, for example. The photosensitive resin may further include a thermoplastic resin, a resin for controlling a softening point, or a resin for improving strength, for example. The photosensitive resin may include an inorganic filler, or a carbon nanotube, for example. In addition, the photosensitive resin may further include a conducting material as a countermeasure against static electricity, for example.

Opening 11

The liquid ejection board 20 includes the openings 11 in communication with the liquid channels 6. The openings 11 are included in addition to the liquid ejection openings 7 and the liquid supply passages 3. At least a portion of the openings 11 is closed by the liquid ejection head component 10. The position of the openings 11 is not limited as long as the openings 11 are in communication with the liquid channels 6. The openings 11 may be formed in the rear surface 12 (second surface) of the substrate 1, may be formed in the liquid supply opening member 8 as illustrated in FIGS. 2A to 2G, or may be formed in the channel defining member 2. The openings 11 do not need to be entirely closed, and may be partly closed if a leaked liquid does not cause an issue. In the liquid ejection head illustrated in FIGS. 2A to 2G, a portion of the openings 11 may remain unclosed due to unintentional misalign or on purpose, for example, and the unclosed portion may be used as a liquid supply opening. However, as the liquid ejection head illustrated in FIGS. 8A to 8D, if a leaked liquid causes an issue, the openings 11 can be closed by the liquid ejection head component 10 such that the liquid supply openings 9 allow the liquid to flow therethrough and the openings 11 do not allow the liquid to flow therethrough.

Figure 6C:
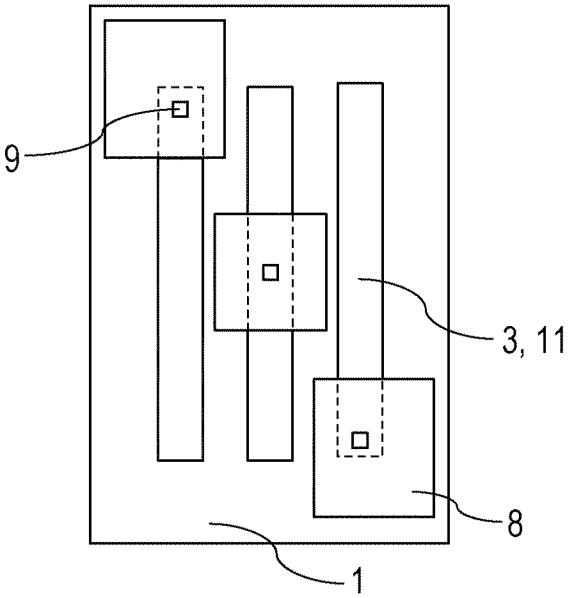
FIGS. 6A to 6C are views illustrating an example of a liquid ejection head board according to the invention.
Figure 6B:
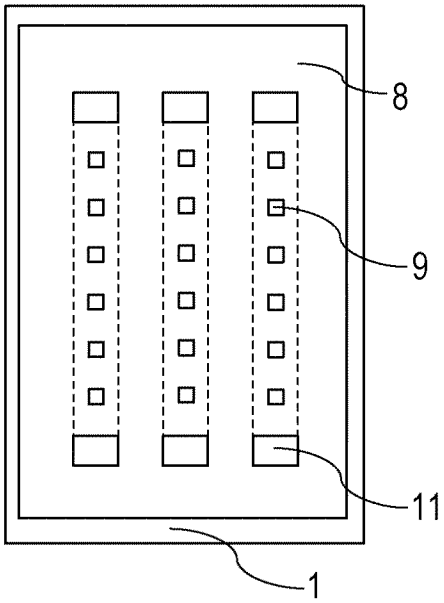
Figure 6A:
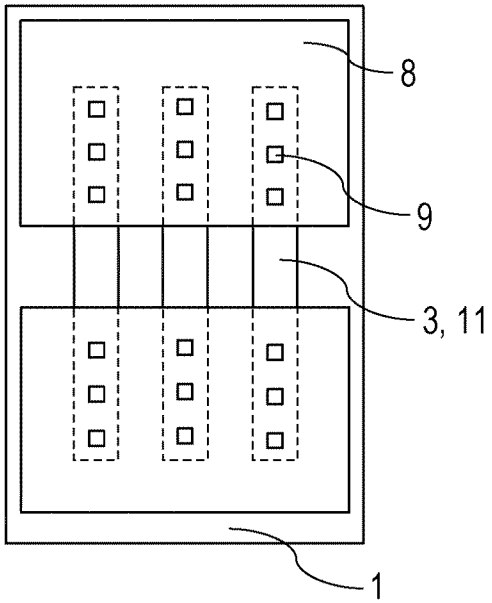

The size, shape, number, and position of the openings 11 are determined without limitations and are not limited to those illustrated in the drawings. As illustrated in FIGS. 6A to 6C, the openings 11 may have any size and any shape having a linear portion, a curved portion, or a combination of the linear portion and the curved portion. Each opening 11 can have a larger opening cross-sectional area than each liquid supply opening 9 to further improve the productivity. The opening cross-sectional area of the openings 11 is larger than that of the liquid ejection openings 7 and that of the liquid supply openings 9. Specifically, an inscribed circle of the openings 11 is made larger than that of the liquid ejection openings 7 and that of the liquid supply openings 9 to allow the openings 11 to have a larger opening width than the liquid ejection openings 7 and the liquid supply openings 9. This enables foreign substances, which may be stuck in the liquid ejection openings 7 or the liquid supply openings 9 to be discharged. In addition, the openings 11 having a larger opening cross-sectional area enable a solvent used in steps of development, release, and cleaning, for example, to readily flow therein. This offers a broader range of choice of liquids in respect of surface tension.

In the case that the liquid supply passage 3 includes a plurality of liquid supply passage 3, the openings 11, which are in communication with the liquid supply passages 3, may be provided for not all of the liquid supply passages 3. Such a configuration also provides the advantages of the invention. However, at least one opening 11 can be provided for each of the liquid supply passages 9 to obtain more advantages. Specifically, at least one of the openings 11 and at least one of the liquid supply openings 9 can be provided for each of the liquid supply passages 3.

If the liquid supply opening member 8 and the substrate 1 have different coefficients of thermal expansion, the openings 11 reduce the stress. This may reduce wafer warpage, and may reduce the possibility that the liquid supply opening member 8 may be detached from the substrate 1.

Liquid Ejection Head Component 10

In the liquid ejection head illustrated in FIG. 1 and FIGS. 2A to 2G, the liquid ejection head component 10 is a supporting member that supports the liquid ejection board 20. The liquid ejection head component 10 includes channels 13 in communication with the liquid supply openings 9. In the liquid ejection head according to the invention, at least a portion of the openings 11 are closed by the liquid ejection head component 10. The liquid ejection head component 10 may be a component such as a mounted component of the liquid ejection head, an adhesive, or a sealing agent, for example, other than the supporting member. The mounted component may be formed of plastic such as polystyrene, polyphenylenesulfide, acrylic, high impact polystyrene, polypropylene, polyethylene, nylon, polysulfone, or polycarbonate, a mixture of the plastic and an inorganic filler, a copolymer of the plastic, and an epoxy compound, a metal material, or a ceramic material, for example. The adhesive and the sealing agent may be formed of a heat curing or light curing epoxy resin.

In the steps of development, release, cleaning, and drying in the steps of producing the liquid ejection head, residues or a takt time (measure time) may cause an issue. After the liquid supply openings 9 and the openings 11 are formed, the liquid ejection head component 10 closes at least a portion of the openings 11. This configuration reduces the possibility that a defect is caused by insufficient drying in the production steps or by residues, improving the quality of the nozzle and the yield. In addition, this configuration shortens the drying time, for example, and thus the productivity is improved. A portion of the liquid supply openings 9 may also be closed in addition to the openings 11 if the misalignment, for example, occurs in the step of closing the openings 11. The liquid supply openings 9 may be partly closed as long as the supply of the liquid such as an ink is not disturbed. As described above, a portion of the openings 11 may remain open due to misalignment, for example, in the step of closing the openings 11.

Figure 4:
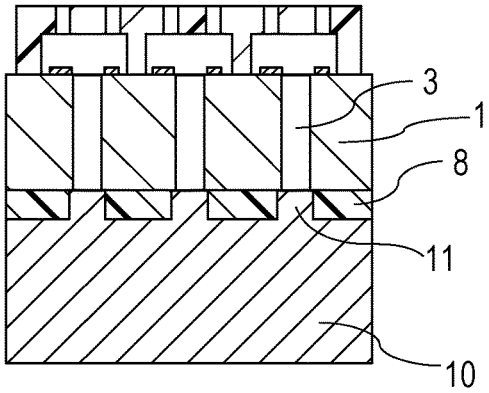
FIG. 4 is a view illustrating an example of a liquid ejection head according to the invention.

FIG. 4 is a cross-sectional view corresponding to the cross-sectional view in FIG. 2F. As illustrated in FIG. 4, a portion of the liquid ejection head component 10 may be positioned in the openings 11. This configuration increases an area of contact and does not allow the liquid ejection board 20 and the liquid ejection head component 10 to be readily detached from each other. In addition, this configuration is used for positioning, for example.

Figure 5A:
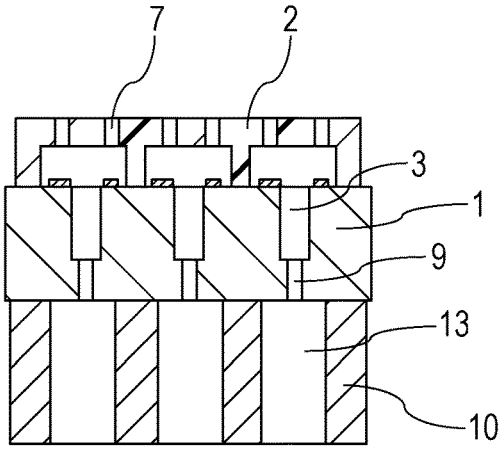
FIGS. 5A and 5B are views illustrating an example of a liquid ejection head according to the invention.
Figure 5B:
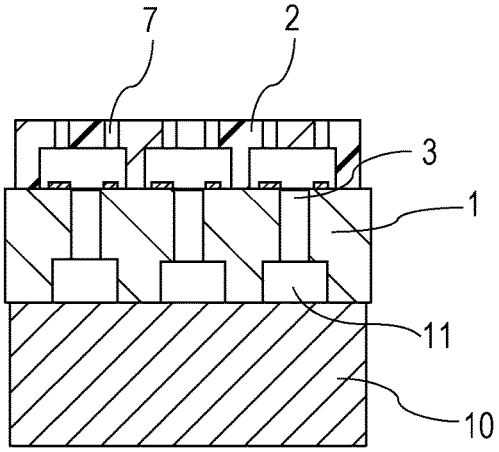

FIG. 5A is a cross-sectional view corresponding to the cross-sectional view in FIG. 2E, and FIG. 5B is a cross-sectional view corresponding to the cross-sectional view in FIG. 2F. As illustrated in FIG. 5A and FIG. 5B, the liquid ejection head according to the invention does not include the liquid supply opening member 8, and the substrate 1 may have the liquid supply openings 9 and the openings 11 in addition to the liquid supply passages 3. In addition, in the invention, at least two of the substrate 1, the channel defining member 2, and a member having the liquid supply opening 9 may be formed of the same material. Since the same material is used to form the components, the number of the materials is reduced, providing advantages such as a decrease in the number of apparatuses for producing the components. In addition, this reduces the possibility that the components will be detached from each other, which may be readily caused between components made of different materials.

FIGS. 6A to 6C illustrate examples of an arrangement of the liquid supply passages 3, the liquid supply opening member 8, and the openings 11 of the liquid ejection board 20 of the embodiment including the liquid supplying opening member 8. As illustrated in FIG. 6A, the liquid supply opening member 8 may be separated into a plurality of portions. As illustrated in FIG. 6B, the openings 11 each may be positioned at an opening end of the liquid supply passage 3 in communication with the opening 11. This enables a solvent such as a cleaning liquid to be readily released during rotational drying or blow drying, which is performed after a wet process, in the steps of producing the liquid ejection board 20. Thus, the cleaning liquid is unlikely to be retained in the liquid supply passages 3. As a result, the cleaning characteristic and the productivity are improved. In addition, as illustrated in FIG. 6C, an area covered with the liquid supply opening member 8 may be smaller than an area not covered with the liquid supply opening member 8.

Figure 7A:
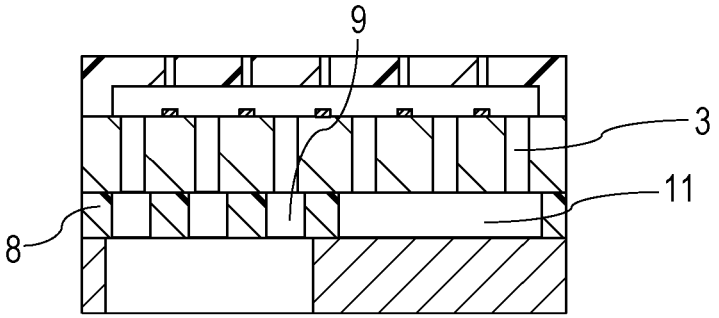
FIGS. 7A to 7D are views illustrating an example of a liquid ejection head according to the invention.
Figure 7B:
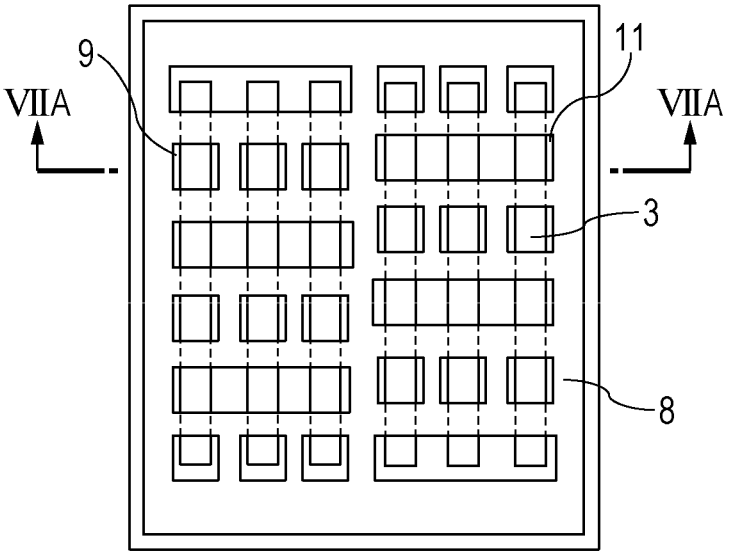
Figure 7C:
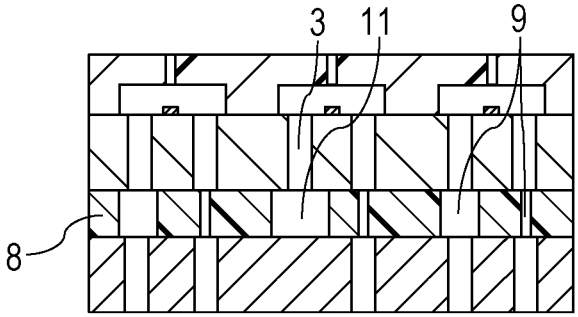
Figure 7D:
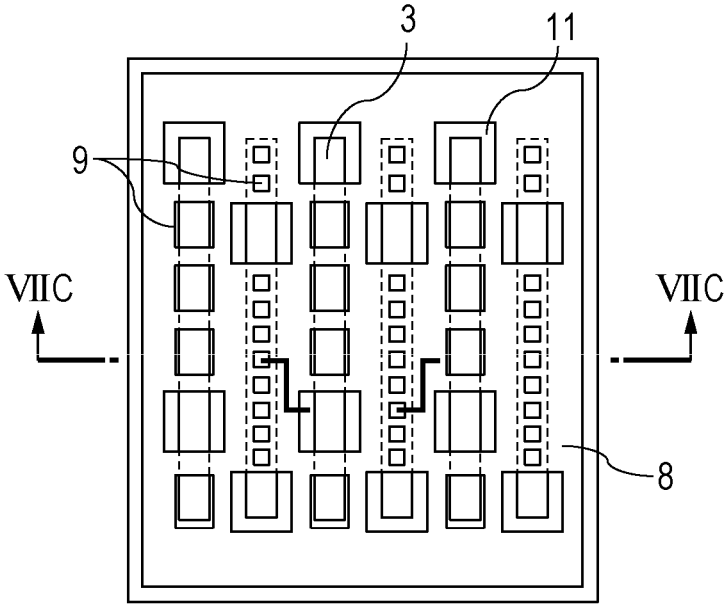

FIGS. 7A to 7D are views illustrating another embodiment including the liquid supply opening member 8. FIGS. 7B and 7D each illustrate an arrangement of the liquid supply passages 3, the liquid supply opening member 8, and the openings 11 as in FIGS. 6A to 6C. FIGS. 7A and 7C are cross-sectional views. As illustrated in FIGS. 7A and 7B, the liquid supply openings 9 and the opening 11 may be formed over a plurality of the liquid supply passages 3. As illustrated in FIGS. 7C and 7D, the liquid supply openings 9 and the openings 11 may have different sizes. The positions of the liquid supply openings 9 and the openings 11 are not limited to those illustrated in FIGS. 7A to 7D, and may be determined without limitations.

Figure 8A:
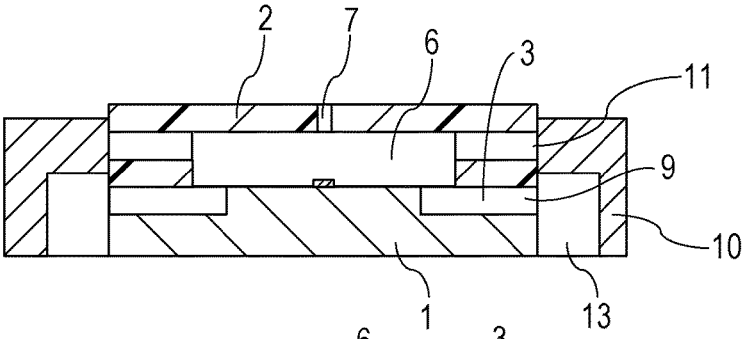
FIGS. 8A to 8D are views illustrating an example of a liquid ejection head according to the invention.
Figure 8B:
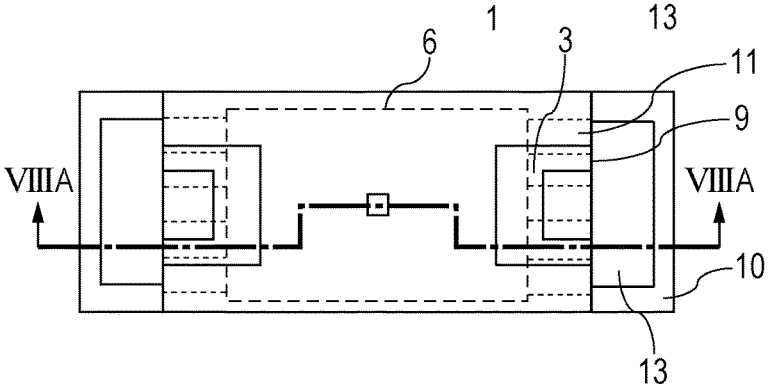
Figure 8C:
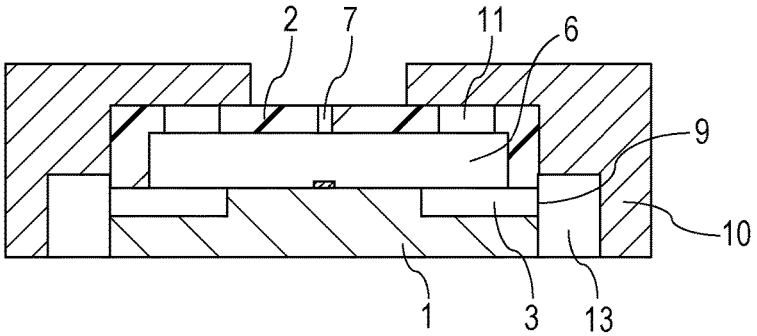
Figure 8D:
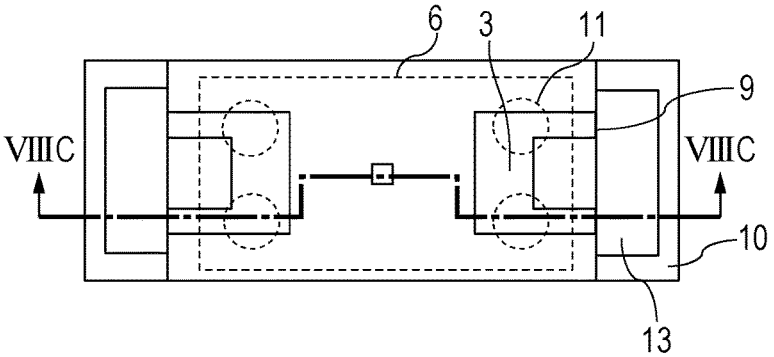

The openings 11 may be formed in any member other than the liquid supply opening member 8 of the liquid ejection board 20, as long as the openings 11 are in communication with the liquid channels 6. The openings 11 may be indirectly in communication with the liquid supply passages 3, and may be formed in the channel defining member 2, for example. FIGS. 8A to 8D illustrate the channel defining member 2 having the openings 11. FIGS. 8A and 8C are vertical cross-sectional views as in FIG. 2A, for example. FIGS. 8B and 8D are horizontal cross-sectional views. The vertical cross-sectional views in FIGS. 8A and 8C are taken along line VIII A-VIII A and VIII C-VIII C in FIGS. 8B and 8D, respectively. In the liquid ejection head illustrated in FIGS. 8A to 8D, the openings 11 are formed in the channel defining member 2, and the liquid supply openings 9 are formed in the substrate 1. In addition, as illustrated in FIGS. 8A to 8D, the liquid supply passages 3 and the openings 11 may be arranged at any position. As illustrated in FIGS. 8C and 8D, the openings 11 and the liquid ejection opening 7 may be positioned in the same surface. In such a case, a distance between the liquid ejection opening 7 and a subject onto which the liquid is ejected increases by the thickness of the liquid ejection head component 10 closing the opening 11. As illustrated in FIGS. 8A and 8B, the openings 11 may be formed in a surface different from the surface including the liquid ejection opening 7 (surface facing the surface including the liquid ejection opening 7 or a side surface, for example). In such a case, the distance between the liquid ejection opening 7 and a subject onto which the liquid is ejected does not increase.

The openings 11 may be used as identification marks such as numbering marks and alignment marks. The liquid ejection head may be configured to use the openings 11 to perform a function. Examples of the function includes a function of evaluating the liquid, a function of exchanging energy with the liquid, a function of controlling a state of the liquid, and a function of controlling a state of the liquid ejection head. The evaluation of the liquid by using the openings 11 is performed through a temperature, an electric potential, an absorption spectrum, or appearance, for example. A material having high electromagnetic wave transmission may be used to form the liquid ejection head component 10 such that reflection or absorption, for example, of the electromagnetic wave is used for the evaluation. A terminal for determining the temperature or the electric potential, for example, may be disposed in the opening 11. The opening 11 may be used to heat the liquid. A piezoelectric element, for example, may be disposed in the opening 11 such that energy for ejection is mechanically applied to the liquid. An electric potential of the liquid, for example, may be controlled by using the opening 11, such that a metal member of the liquid ejection head does not melt, for example.

Examples of the function of exchanging energy with the liquid by using the opening 11 include a function of exchanging thermal energy to adjust the temperature of the liquid and a function of exchanging kinetic energy to transmit force that moves the liquid, for example. Examples of the function of controlling the state of the liquid by using the opening 11 include a function of controlling the temperature of the liquid to an optimum value and a function of modifying the composition of the liquid, for example, based on the evaluation of the state of the liquid. Examples of the function of controlling the state of the liquid ejection head by using the opening 11 include a function of adjusting the temperature of the liquid ejection head or an energy amount applied to the energy generating devices 4, for example, based on the evaluation of the state of the liquid.

As described above, the liquid ejection head according to the invention can have the function of evaluating the liquid by using the opening 11 or the function of exchanging energy with the liquid by using the opening 11 while the opening 11 is closed by the liquid ejection head component 8. The function of controlling the state of the liquid by using the opening 11 or the function of controlling the state of the liquid ejection head by using the opening 11 can be particularly employed in the liquid ejection head of the invention.

FIGS. 3A to 3G are views illustrating an example of a liquid ejection head known in the art in the same manner as in FIGS. 2A to 2G. The liquid ejection head illustrated in FIGS. 3A to 3G does not include the openings 11 illustrated in FIGS. 2A to 2G. Thus, in the steps of development, release, cleaning, and drying, for example, in the steps of producing the liquid ejection head, the liquid ejection openings 7 and the liquid ejection openings 9 are only openings allowing a space including the liquid supply passages 3 and the liquid channels 6 to be in communication with an external space. The liquid ejection openings 7 and the liquid supply openings 9 each have a smaller opening cross-sectional area than the liquid supply passages 3 and the liquid channels 6. This deteriorates ejection efficiency of the liquid from the space including the liquid supply passages 3 and the liquid channel 6, causing stagnation of the liquid. As a result, a defect such as generation of residue may be readily caused in the steps of development, release, cleaning, or drying, for example.

In the liquid ejection head according to the invention, the openings 11 lower a resistance against a fluid. This improves ejection properties determined by an amount of ejection or a speed of ejection, for example, and reduces stagnation of the liquid. The reduction in the stagnation of the liquid enables a causative substance of residues to be readily ejected, leading to a reduction in generation of residues, for example, in the steps of producing the liquid ejection board 20. As a result, the quality and the yield rate of the liquid ejection heads are improved.

A component dissolved in the stagnant liquid may become a residue when changed to be in a solid state by drying and may become attached to the liquid supply passages 3 or the liquid channels 6, for example, or a foreign substance may become a residue when not ejected and remains in the liquid supply passages 3 or the liquid channels 6, for example. The component dissolved in the liquid may be a material of the channel defining member 2 or the liquid supply opening member 8, a resist, or other materials used in the production of the liquid ejection head. The foreign substance may be a particle entered the liquid supply passages 3 or the liquid channels 6 from the outside during the steps of producing the liquid ejection head. A new foreign substance may be generated during the steps of forming the liquid ejection head. During the step of forming the liquid supply passage 3, a substance attached to the liquid supply passage 3 or burr, for example, may be detached and become a foreign substance in some cases.

An example of a method of producing the liquid ejection head according to the invention is described. The method of producing the liquid ejection head according to the invention includes a step A of forming the liquid ejection board 20 and a step B of forming the liquid ejection head component 10 on the liquid ejection board 20. The step A includes the following steps (a) to (d):

(a) forming an energy generating device 4 on a front surface 5 (first surface) of a substrate 1;

(b) forming a channel defining member 2 defining a liquid channel 6 and having a liquid ejection opening 7 in communication with the liquid channel 6 on the front surface of the substrate 1, the channel defining member 2 allowing a liquid to be in contact with the energy generating device 4, the liquid ejection opening through which the liquid is ejected;

(c) forming a liquid supply passage 3 in communication with the liquid channel 6; and (d) forming a liquid supply opening 9 in communication with the liquid supply passage 3, the liquid supply opening 9 having a smaller opening cross-sectional area taken in a direction perpendicular to a flow direction of the liquid than the liquid supply passage 3.

The step A of forming the liquid ejection board 20 further includes forming an opening 11 in the liquid ejection board 20 so as to in communication with the liquid channel 6. The opening 11 is formed in addition to the liquid ejection opening 7 and the liquid supply passage 3. Furthermore, in the step B of forming the liquid ejection head component 10, the liquid ejection head component 10 closes at least a portion of the opening 11.

The order of the above-described steps is not limited to the above-described order, and the order may be changed as appropriate. In the step A, the step (b) of forming a channel defining member 2 on the substrate 1 may be performed before or after the step (c) of forming a liquid supply passage 3 in the substrate 1. The method of forming the liquid ejection head according to the invention may further include forming a liquid supply opening member 8 on the rear surface 12 (second surface) of the substrate 1 opposite the front surface 5. In the step (d) of the step A, the liquid supply opening 9 may be formed in the liquid supply opening member 8. In such a case, the order of this step and the above-described steps is not limited. In the case that the liquid supply opening member 8 is formed after the formation of the channel defining member 2, an issue of residues, for example, is likely to occur in the steps of development, release, cleaning, or drying, for example, in the steps of forming the liquid supply opening member 8. In the case that the liquid supply opening member 8 is formed after the formation of the channel defining member 2, an issue of residues, for example, is likely to occur in the steps of development, release, cleaning, or drying, for example, in the step of forming the channel defining member 2.

Figure 9A:
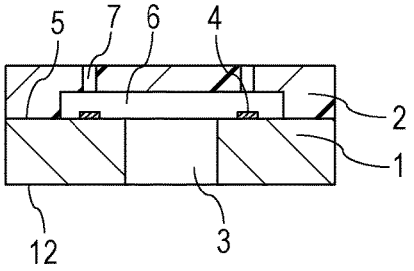
FIGS. 9A to 9E are views illustrating an example of a method of producing a liquid ejection head.

An example of the method of producing the liquid ejection head according to the invention is described in detail with reference to FIGS. 9A to 9E. As illustrated in FIG. 9A, a substrate 1 having a channel defining member 2 and energy generating devices 4 on a front surface 5 of the substrate 1 is provided, and a liquid supply passage 3 is formed in the substrate 1. Then, as illustrated in a cross-sectional view in FIG. 9B (taken along line corresponding to line IIA-IIA in FIG. 2A) and in a cross-sectional view in FIG. 9C (taken along line corresponding to line IIF-IIF in FIG. 2B), a liquid supply opening member 8 having an opening 11 and liquid supply openings 9 is formed. Subsequently, as illustrated in FIGS. 9D and 9E, a liquid ejection head component 10 is formed to close the openings 11.

The liquid supply opening member 8 may be formed before the channel defining member 2 and the energy generating devices 4 are formed. Before the liquid supply opening member 8 is formed, a protective film may be provided to reduce damage to the channel defining member 2. The protective film may be formed of resin, metal, semiconductor, or insulating material, for example. The protective film may be a film formed by spin coating or a dry film, for example. A protective tape, for example, may be attached as the protective film. The protective film may fill liquid ejection openings 7, the liquid channel 6, or the liquid supply passage 3. The filling of the protective film may be performed in a vacuum state. The protective film may be formed of a combination of materials, and may include a plurality of layers. An apparatus configured to cause less damage to the liquid channel defining member 2 may be employed, instead of the protective film, to reduce damage to the channel defining member 2.

When the liquid ejection head including the opening 11 according to the invention is produced, a fluid can be allowed to flow from the liquid ejection openings 7 or the liquid supply openings 9 toward the opening 11 during the step of forming the liquid supply openings 9 or after the step of forming the liquid supply openings 9. A foreign substance having a larger size than the liquid ejection openings 7 and the liquid supply openings 9 and a smaller size than the opening 11 may be in the liquid supply passage 3 and the liquid channel 6. In such a case, the flow of the fluid forces the foreign substance to be ejected to the outside, reducing defects caused by the foreign substances. Even when the liquid ejection openings 7 are desired to be away from the fluid, the fluid flowing from the liquid supply openings 9 toward the opening 11 forces the foreign substances in the liquid channel 6 and the liquid supply passage 3 to be ejected. The fluid may be a liquid for development, release, or cleaning, a gas for drying, a solid such as dry ice, which can change from a solid to a gas, or a mixture thereof, for example. The fluid may be sucked through the opening 11.

The liquid ejection head according to the invention may constitute a liquid ejection system. Examples of the liquid ejection system include a printer, a copier, a facsimile including a communication system, a word processor including a printer section, a mobile device, and a multi-functional industrial apparatus including a processing apparatus. A subject to which the liquid is ejected may be a two-dimensional structure, or a three-dimensional structure. The liquid may be ejected into a space. The liquid ejection system may be applied to semiconductor manufacturing apparatuses, medical devices, or modeling devices such as a 3D printer.

EXAMPLES

Hereinafter, the invention is described in detail by using examples, but the invention is not limited to the examples.

Example

As illustrated in FIG. 9A, a member including a substrate 1 and a channel defining member 2 disposed on a front surface 5 (first surface) of the substrate 1 was provided. The substrate 1 has energy generating devices 4 including a resistance substance including TaSiN on the front surface 5 of the substrate 1. The substrate 1 has a liquid supply passage 3 extending between the front surface 5 and a rear surface 12 of the substrate 1. The channel defining member 2 includes a liquid channel 6 and liquid ejection openings 7. The substrate 1 is a silicon substrate. A negative photosensitive resin (product name: EHPE-3150 available from Daisel Corporation) was used to form the channel defining member 2. The liquid channel 6 and the liquid ejection openings 7 were formed by lithography, for example.

Figure 9B:
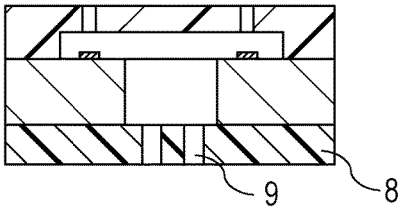
Figure 9C:
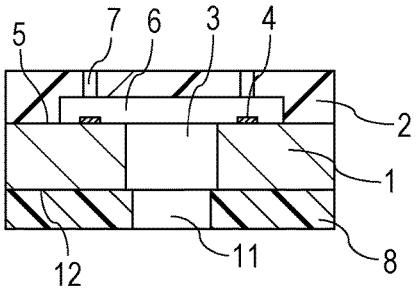
Figure 9D:
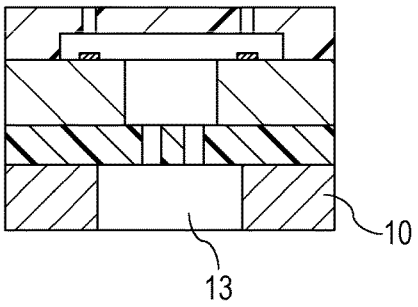
Figure 9E:
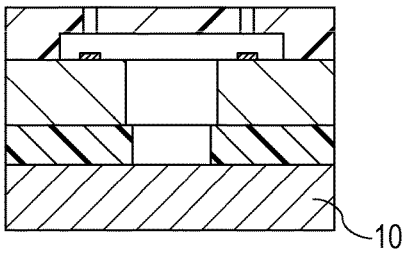

Then, as illustrated in FIGS. 9B and 9C, a liquid supply opening member 8 was formed. At first, a protective tape (not illustrated) was provided to protect the channel defining member 2. Secondary, a dry film formed of the above-described negative photosensitive resin was attached to the rear surface 12 of the substrate 1. After the negative photosensitive resin was exposed to a light in a stepper (product name: FPA-3000i5+, available from CANON KABUSHIKI KAISHA), the protective tape was removed. Then, the negative photosensitive resin was developed to form the liquid supply opening member 8. In this step, the liquid supply openings 9 and the opening 11 were formed to have different sizes by using a photomask having holes of different sizes. The opening 11 was formed to have a larger opening cross-sectional area than the liquid supply openings 9. Subsequently, the member was immersed in a cleaning liquid contained in a cleaning tank such that the cleaning liquid fills spaces in the member, and the member was subjected to ultrasonic cleaning, and then dried. In addition, the member was baked in an oven at a temperature of 200° C. such that the negative photosensitive resin is further cured. As a result, the liquid ejection board 20 was formed.

Then, as illustrated in FIGS. 9D and 9E, a liquid ejection head component 10, which is a molded component, was attached to (disposed on) the thus formed liquid ejection board 20 such that the liquid ejection head component 10 closes the opening 11. As a result, the liquid ejection head was formed.

Comparative Example

Figure 10A:
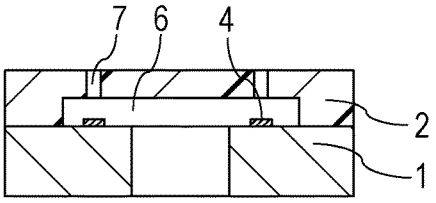
FIGS. 10A to 10E are views illustrating an example of a method of producing a conventional liquid ejection head.
Figure 10B:
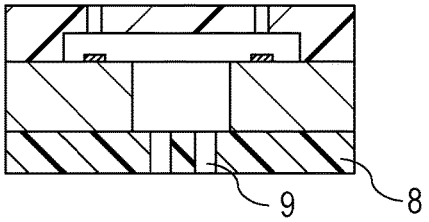
Figure 10C:
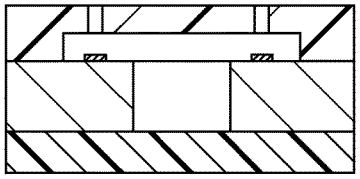
Figure 10D:
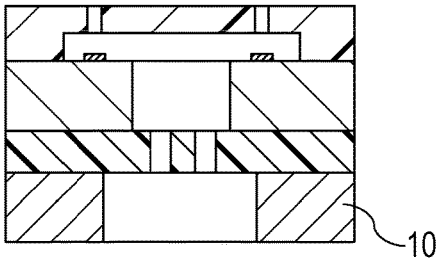
Figure 10E:
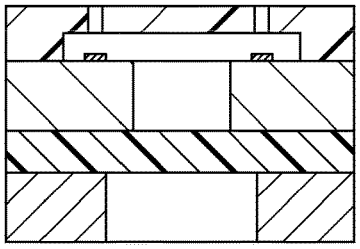

A comparative example is illustrated in FIGS. 3A to 3G and FIGS. 10A to 10E. FIGS. 10A, 10B, and 10D are cross-sectional views taken along line corresponding to IIIA-IIIA, IIIC-IIIC in FIGS. 3B and 3D. FIGS. 10C and 10E are cross-sectional views taken along line corresponding to line IIIF-IIIF in FIGS. 3B and 3D. In the comparative example, the liquid ejection head was produced in the same manner as in the example, except that the opening 11 illustrated in FIG. 9C was not formed and a channel 13 of the liquid ejection head component 10 extends continuously.

The liquid ejection heads of the first example and the comparative example were subjected to appearance inspection using a metallurgical microscope (available from Olympus Corporation, AL1100) to determine whether a residue was generated. It was found that the residue was generated in the comparative example, and the residue was not generated in the example.

The result shows that the employment of the liquid ejection head having the openings according to the invention reduces the generation of the residue in the steps of development, cleaning, and drying.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-151547, filed Jul. 31, 2015, which is hereby incorporated by reference herein in its entirety.

What is claimed is:

1. A liquid ejection head comprising:

a liquid ejection board including:

a substrate;

an energy generating device on a first surface of the substrate;

a channel defining member defining a liquid channel and having a liquid ejection opening in communication with the liquid channel, the liquid channel allowing a liquid to be in contact with the energy generating device, the liquid ejection opening through which the liquid is ejected;

a liquid supply passage in communication with the liquid channel;

a liquid supply opening in communication with the liquid supply passage, the liquid supply opening having a smaller opening cross-sectional area taken in a direction perpendicular to a flow direction of a liquid than the liquid supply passage; and an opening in communication with the liquid channel, the opening being included in addition to the liquid ejection opening and the liquid supply passage; and a liquid ejection head component disposed on the liquid ejection head so as to close at least a portion of the opening, wherein the opening is formed in a second surface of the substrate opposite the first surface.

2. The liquid ejection head according to claim 1, wherein the liquid supply passage is a portion of through holes extending between the first surface and the second surface of the substrate.

3. The liquid ejection head according to claim 2, wherein the liquid supply opening is a portion of one of the through holes in the substrate and is positioned adjacent to the second surface of the substrate.

4. A method of producing a liquid ejection head, comprising:

forming a liquid ejection board, the forming including:

forming an energy generating device on a first surface of a substrate;

forming a channel defining member defining a liquid channel and having a liquid ejection opening in communication with the liquid channel on the first surface of the substrate, the channel defining member allowing a liquid to be in contact with the energy generating device, the liquid ejection opening through which the liquid is ejected;

forming a liquid supply passage in communication with the liquid channel;

forming a liquid supply opening in communication with the liquid supply passage, the liquid supply opening having a smaller opening cross-sectional area taken in a direction perpendicular to a flow direction of a liquid than the liquid supply passage; and forming an opening in the liquid ejection board so as to be in communication with the liquid channel, the opening being formed in addition to the liquid ejection opening and the liquid supply passage; and disposing a liquid ejection head component on the liquid ejection board such that the liquid ejection head component closes at least a portion of the opening, wherein the opening is formed in a second surface of the substrate opposite the first surface.

5. The method of producing a liquid ejection head according to claim 4, wherein the liquid supply passage is a portion of through holes extending through the substrate between the first surface and the second surface of the substrate, and the opening is in communication with the liquid supply passage.

* * * * *